US008521519B2

(12) United States Patent
Sato et al.

(10) Patent No.: US 8,521,519 B2
(45) Date of Patent: Aug. 27, 2013

(54) ADAPTIVE AUDIO SIGNAL SOURCE VECTOR QUANTIZATION DEVICE AND ADAPTIVE AUDIO SIGNAL SOURCE VECTOR QUANTIZATION METHOD THAT SEARCH FOR PITCH PERIOD BASED ON VARIABLE RESOLUTION

(75) Inventors: Kaoru Sato, Kanagawa (JP); Toshiyuki Morii, Kanagawa (JP)

(73) Assignee: Panasonic Corporation, Osaka (JP)

( * ) Notice: Subject to any disclaimer, the term of this patent is extended or adjusted under 35 U.S.C. 154(b) by 1036 days.

(21) Appl. No.: 12/528,661

(22) PCT Filed: Feb. 29, 2008

(86) PCT No.: PCT/JP2008/000405

§ 371 (c)(1),
(2), (4) Date: Aug. 26, 2009

(87) PCT Pub. No.: WO2008/108081

PCT Pub. Date: Sep. 12, 2008

(65) Prior Publication Data

US 2010/0063804 A1 Mar. 11, 2010

(30) Foreign Application Priority Data

Mar. 2, 2007 (JP) ..... 2007-053529

(51) Int. Cl.
*G10L 11/04* (2006.01)

(52) U.S. Cl.
USPC ..... 704/207; 704/219; 704/222; 704/220; 704/208

(58) Field of Classification Search
USPC ..... 704/219, 207, 222, 223, 233, 201, 704/220, 230, 208, 500–504, 229
See application file for complete search history.

(56) References Cited

U.S. PATENT DOCUMENTS

| | | | | |
|---|---|---|---|---|
| 5,513,297 | A * | 4/1996 | Kleijn et al. | 704/223 |
| 5,699,485 | A * | 12/1997 | Shoham | 704/223 |
| 5,704,003 | A * | 12/1997 | Kleijn et al. | 704/220 |
| 5,732,389 | A * | 3/1998 | Kroon et al. | 704/223 |
| 5,787,389 | A * | 7/1998 | Taumi et al. | 704/219 |

(Continued)

FOREIGN PATENT DOCUMENTS

| | | |
|---|---|---|
| JP | 4-305135 | 10/1992 |
| JP | 2000-112498 | 4/2000 |
| JP | 2003-44099 | 2/2003 |

OTHER PUBLICATIONS

"3GPP-Standards", 2500 Wilson Boulevard, Suite 300, Arlington, Virginia 22201 USA, XP040290750, Dec. 31, 2004.

(Continued)

*Primary Examiner* — Vijay B Chawan
(74) *Attorney, Agent, or Firm* — Greenblum & Bernstein, P.L.C.

(57) ABSTRACT

An adaptive sound source vector quantization device includes a first pitch cycle instructor, a search range calculator, and a second pitch cycle instructor. The first pitch cycle instructor successively instructs pitch cycle search candidates in a predetermined search range having a search resolution which transits over a predetermined pitch cycle candidate for the first sub-frame. The search range calculator calculates a predetermined range before and after the pitch cycle of the first sub-frame as the pitch cycle search range for the second sub-frame, if the predetermined range includes the predetermined pitch cycle search candidate. In the predetermined range, the search resolution transits over a boundary defined by the predetermined pitch cycle. The second pitch cycle instructor successively instructs the pitch cycle search candidates in the search range for the second sub-frame.

4 Claims, 8 Drawing Sheets

(56) References Cited

U.S. PATENT DOCUMENTS

| | | | | |
|---|---|---|---|---|
| 6,014,618 | A * | 1/2000 | Patel et al. | 704/207 |
| 6,470,310 | B1 * | 10/2002 | Oshikiri et al. | 704/207 |
| 6,581,031 | B1 * | 6/2003 | Ito et al. | 704/222 |
| 6,584,437 | B2 * | 6/2003 | Heikkinen et al. | 704/207 |
| 6,704,702 | B2 * | 3/2004 | Oshikiri et al. | 704/207 |
| 6,959,274 | B1 * | 10/2005 | Gao et al. | 704/219 |
| 7,191,120 | B2 * | 3/2007 | Oshikiri et al. | 704/219 |
| 7,222,070 | B1 * | 5/2007 | Stachurski et al. | 704/207 |
| 8,200,483 | B2 * | 6/2012 | Sato et al. | 704/222 |
| 2003/0004709 | A1 * | 1/2003 | Heikkinen et al. | 704/207 |
| 2004/0002856 | A1 * | 1/2004 | Bhaskar et al. | 704/219 |
| 2004/0030545 | A1 | 2/2004 | Sato et al. | |
| 2004/0102970 | A1 * | 5/2004 | Oshikiri et al. | 704/233 |
| 2007/0136051 | A1 | 6/2007 | Sato et al. | |
| 2009/0198491 | A1 | 8/2009 | Sato et al. | |

OTHER PUBLICATIONS

Rapporteur Q10/16, "Draft revised ITU-T Recommendation G. 729 Coding of speech at 8kbit/s using conjugate-structure algebraic-code-excited linear-prediction (CS-ACELP)", ITU-T SG16 Meeting; Nov. 14-24, 2006; Geneva, No. T05-SG16-061114-TD-WP3-0182, XP030100355, Nov. 7, 2006, pp. 86, line 18—p. 87, last line.
Search report from E.P.O., mail date is Mar. 2, 2012.
English language Abstract of JP 4-305135, Oct. 28, 1992.
English language Abstract of JP 2000-112498, Apr. 21, 2000.
English language Abstract of JP 2003-44099, Feb. 14, 2003.
"IEEE proc. ICASSP", 1985, "Code Excited Linear Prediction: High Quality Speech at Low Bit Rate", written by M. R. Schroeder, B. S. Atal, pp. 937-940.
"ITU-T Recommendation G 729", ITU-T, 19996/6.
U.S. Appl. No. 12/529,212 to Oshikiri, filed Aug. 31, 2009.
U.S. Appl. No. 12/528,661 to Sato et al, filed Aug. 26, 2009.
U.S. Appl. No. 12/528,671 to Kawashima et al, filed Aug. 26, 2009.
U.S. Appl. No. 12/528,869 to Oshikiri et al, filed Aug. 27, 2009.
U.S. Appl. No. 12/528,877 to Morii et al, filed Aug. 27, 2009.
U.S. Appl. No. 12/529,219 to Morii et al, filed Aug. 31, 2009.
U.S. Appl. No. 12/528,871 to Morii et al, filed Aug. 27, 2009.
U.S. Appl. No. 12/528,878 to Ehara, filed Aug. 27, 2009.
U.S. Appl. No. 12/528,880 to Ehara, filed Aug. 27, 2009.

* cited by examiner

ADAPTIVE AUDIO SIGNAL SOURCE VECTOR QUANTIZATION DEVICE AND ADAPTIVE AUDIO SIGNAL SOURCE VECTOR QUANTIZATION METHOD THAT SEARCH FOR PITCH PERIOD BASED ON VARIABLE RESOLUTION

TECHNICAL FIELD

The present invention relates to an adaptive excitation vector quantization apparatus and adaptive excitation vector quantization method for carrying out adaptive excitation vector quantization in speech coding based on a CELP (Code Excited Linear Prediction) scheme. More particularly, the present invention relates to an adaptive excitation vector quantization apparatus and an adaptive excitation vector quantization method for carrying out adaptive excitation vector quantization used for a speech encoding/decoding apparatus that performs transmission of a speech signal in fields such as a packet communication system represented by Internet communication and a mobile communication system.

BACKGROUND ART

In the fields of digital radio communication, packet communication represented by Internet communication, speech storage and so on, speech signal encoding/decoding technique is indispensable for efficient use of channel capacity for radio waves and storage media. Particularly, CELP-based speech encoding/decoding technique has become the mainstream technique today (e.g. see Non-Patent Document 1).

A CELP-based speech encoding apparatus encodes input speech based on a prestored speech model. To be more specific, a CELP-based speech encoding apparatus separates a digitized speech signal into frames of regular time intervals on the order of 10 to 20 ms, obtains the linear prediction coefficients ("LPCs") and linear prediction residual vector by performing a linear predictive analysis of the speech signal in each frame, and encodes the linear prediction coefficients and linear prediction residual vector separately. A CELP-based speech encoding/decoding apparatus encodes/decodes a linear prediction residual vector using an adaptive excitation codebook storing excitation signals generated in the past and a fixed codebook storing a specific number of vectors of fixed shapes (i.e. fixed code vectors). Of these codebooks, the adaptive excitation codebook is used to represent the periodic components of the linear prediction residual vector, whereas the fixed codebook is used to represent the non-periodic components of the linear prediction residual vector, which cannot be represented by the adaptive excitation codebook.

The processing of encoding/decoding a linear prediction residual vector is generally performed in units of subframe divide a frame into shorter time units (on the order of 5 to 10 ms) resulting from sub-dividing a frame. ITU-T (International Telecommunication Union—Telecommunication Standardization Sector) Recommendation G.729, cited in Non-Patent Document 2, divides a frame into two subframes and searches for the pitch period in each of the two subframes using the adaptive excitation codebook, thereby performing adaptive excitation vector quantization. To be more specific, adaptive excitation vector quantization is performed using a method called "delta lag," whereby the pitch period in the first subframe is determined in a fixed range and the pitch period in the second subframe is determined in a close range of the pitch period determined in the first subframe. An adaptive excitation vector quantization method that operates in subframe units such as above can quantize an adaptive excitation vector in higher time resolution than an adaptive excitation vector quantization method that operates in frame units.

Furthermore, the adaptive excitation vector quantization described in Patent Document 1 utilizes the nature that the amount of variation in the pitch period between the first subframe and a second subframe is statistically smaller when the pitch period in the first subframe is shorter and the amount of variation in the pitch period between the first subframe and the current subframe is statistically greater when the pitch period in the first subframe is longer, to change the pitch period search range in a second subframe adaptively according to the length of the pitch period in the first subframe. That is, the adaptive excitation vector quantization described in Patent Document 1 compares the pitch period in the first subframe with a predetermined threshold, and, when the pitch period in the first subframe is less than the predetermined threshold, narrows the pitch period search range in a second subframe for increased resolution of search. On the other hand, when the pitch period in the first subframe is equal to or greater than the predetermined threshold, the pitch period search range in a second subframe is widened for lower resolution of search. By this means, it is possible to improve the performance of pitch period search and improve the accuracy of adaptive excitation vector quantization.

Patent Document 1: Japanese Patent Application Laid-Open No. 2000-112498

Non-Patent Document 1: "IEEE proc. ICASSP", 1985, "Code Excited Linear Prediction: High Quality Speech at Low Bit Rate", written by M. R. Schroeder, B. S. Atal, p. 937-940

Non-Patent Document 2: "ITU-T Recommendation G.729", ITU-T, 1996/3, pp. 17-19

DISCLOSURE OF INVENTION

Problems to be Solved by the Invention

However, the adaptive excitation vector quantization described in above Patent Document 1 compares the pitch period in the first subframe with a predetermined threshold, determines upon one type of resolution for the pitch period search in the second subframe according to the comparison result and determines upon one type of search range corresponding to this search resolution. Therefore, there is a problem that search in adequate resolution is not possible and the performance of pitch period quantization therefore deteriorates in the vicinities of a predetermined threshold. To be more specific, assuming a case where the predetermined threshold is 39, if the pitch period in the first subframe is equal to or less than 39, the pitch period search in a second subframe is carried out in resolution of ⅓ precision, and, if the pitch period in the first subframe is equal to or more than 40, the pitch period search in a second subframe is carried out in resolution of ½ precision. According to a pitch period search method of such specifications, if the pitch period in the first subframe is 39, the resolution of pitch period search in a second subframe is determined to be one type of ⅓ precision, and, consequently, in cases where search at ½ precision is more suitable in, for example, a part in a second subframe where the pitch period is 40 or greater, search nevertheless has to be performed at ⅓ precision. Furthermore, when the pitch period in the first subframe is 40, the resolution of pitch period search in the second subframe is determined to be one type of ½ precision, and, consequently, in cases where search at ⅓ precision is more suitable in, for example, a part in a second subframe where the pitch period is 39 or below, search nevertheless has to be performed at ½ precision.

It is therefore an object of the present invention to provide an adaptive excitation vector quantization apparatus and adaptive excitation vector quantization method, that, using a pitch period search range setting method of changing the range and resolution of pitch period search in a second subframe adaptively according to the pitch period in the first subframe, makes it possible to perform pitch period search always in adequate resolution, in all parts of the pitch period search range in a second subframe, and improve the performance of pitch period quantization.

Means for Solving the Problem

The adaptive excitation vector quantization apparatus according to the present invention searches for a pitch period in a fixed range for a first subframe of two subframes, the two frames being provided by dividing a frame, searches for a pitch period in a second subframe in a range in a vicinity of the pitch period determined in the first subframe, and uses information about the searched pitch period as quantization data, and this adaptive excitation vector quantization apparatus employs a configuration having: a first pitch period search section that searches for a pitch period in the first subframe by changing resolution with respect to a boundary of a predetermined threshold; a calculation section that calculates a pitch period search range in the second subframe based on the pitch period determined in the first subframe and the predetermined threshold; and a second pitch period search section that searches for a pitch period in the second subframe by changing resolution with respect to the boundary of the predetermined threshold in the pitch period search range.

The adaptive excitation vector quantization method according to the present invention searches for a pitch period in a fixed range for a first subframe of two subframes, the two frames being provided by dividing a frame, searches for a pitch period in a second subframe in a range in a vicinity of the pitch period determined in the first subframe and uses information about the searched pitch period as quantization data, and this adaptive excitation vector quantization method includes the steps of: searching for a pitch period in the first subframe by changing resolution with respect to a boundary of a predetermined threshold; calculating a pitch period search range in the second subframe based on the pitch period determined in the first subframe and the predetermined threshold; and searching for a pitch period in the second subframe by changing resolution with respect to the boundary of the predetermined threshold in the pitch period search range.

Advantageous Effects of Invention

According to the present invention, when a pitch period search range setting method of changing the range and resolution of pitch period search in a second subframe adaptively according to the pitch period in the first subframe, it is possible to perform pitch period search always in adequate resolution, in all parts of the pitch period search range in a second subframe, and improve the performance of pitch period quantization. As a result, it is possible to reduce the number of filters to mount to generate adaptive excitation vector of decimal precision and consequently save memory.

BEST MODE FOR CARRYING OUT THE INVENTION

A case will be described below as an example of an embodiment of the present invention where, using a CELP speech encoding apparatus mounting an adaptive excitation vector quantization apparatus, each frame making up a 16 kHz speech signal is divided into two subframes and a linear predictive analysis is performed on a per subframe basis, to determine the linear prediction coefficient and linear prediction residual vector of each subframe. Here, assuming the length of a frame is n and the length of a subframe is m, each frame is divided into two parts to provide two subframes, and therefore $n=m\times 2$ holds. Furthermore, a case will be explained with the present embodiment where pitch period search is performed using eight bits for a linear prediction residual vector of the first subframe obtained in the above linear predictive analysis and where pitch period search for a linear prediction residual vector of the second subframe is performed using four bits.

Now, an embodiment of the present invention will be explained in detail with reference to the accompanying drawings.

Figure 1:
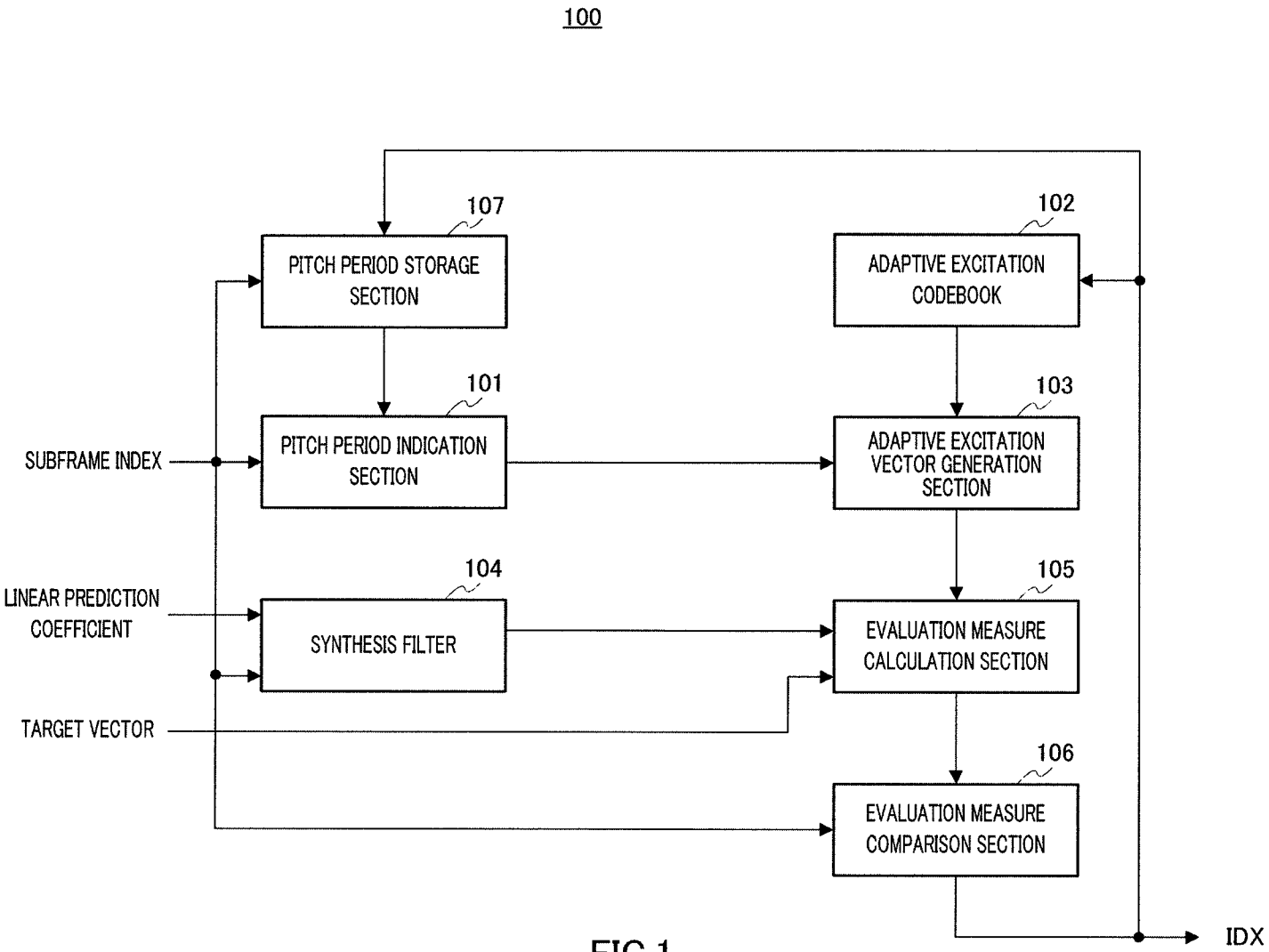
FIG. 1 is a block diagram showing a main configuration of an adaptive excitation vector quantization apparatus according to an embodiment of the present invention.

FIG. 1 is a block diagram showing a main configuration of adaptive excitation vector quantization apparatus 100 according to an embodiment of the present invention.

In FIG. 1, adaptive excitation vector quantization apparatus 100 is provided with pitch period indication section 101, adaptive excitation codebook 102, adaptive excitation vector generation section 103, synthesis filter 104, evaluation measure calculation section 105, evaluation measure comparison section 106 and pitch period storage section 107, and receives as input subframe indexes, linear prediction coefficients and target vectors on a per subframe basis. Of three, the subframe indexes indicate the order of each subframe in a frame, obtained by a CELP speech encoding apparatus mounting adaptive excitation vector quantization apparatus 100 according to the present embodiment, and the linear prediction coefficients and target vectors indicate the linear prediction coefficient and linear prediction residual (excitation signal) vector of each subframe, determined by performing a linear predictive analysis on a per subframe basis in the CELP speech encoding apparatus. Examples of parameters available as linear prediction coefficients include LPC parameters, LSF (Line Spectrum Frequency or Line Spectral Frequency) parameters that are frequency domain parameters convertible with LPC parameters in a one-to-one correspondence, and LSP (line spectrum pair or line spectral pair) parameters.

Pitch period indication section 101 calculates a pitch period search range and pitch period resolution based on subframe indexes received as input on a per subframe basis and the pitch period in the first subframe received as input from pitch period storage section 107, and sequentially indicates pitch period candidates in the calculated pitch period search range, to adaptive excitation vector generation section 103.

Adaptive excitation codebook 102 incorporates a buffer for storing excitations, and updates the excitations using a pitch period index IDX fed back from evaluation measure comparison section 106 every time a pitch period search in subframe units is finished.

Adaptive excitation vector generation section 103 extracts an adaptive excitation vector having a pitch period candidate indicated by pitch period indication section 101 by a subframe length m, from adaptive excitation codebook 102, and outputs the adaptive excitation vector to evaluation measure calculation section 105.

Synthesis filter 104 makes up a synthesis filter using the linear prediction coefficients that are received as input on a per subframe basis, generates an impulse response matrix of the synthesis filter based on the subframe indexes received as input on a per subframe basis and outputs the impulse response matrix to evaluation measure calculation section 105.

Evaluation measure calculation section 105 calculates an evaluation measure for pitch period search using the adaptive excitation vector from adaptive excitation vector generation section 103, the impulse response matrix from synthesis filter 104 and the target vectors received as input on a per frame basis, and outputs the pitch period search evaluation measure to evaluation measure comparison section 106.

Based on the subframe indexes received as input on a per frame basis, in each subframe, evaluation measure comparison section 106 determines the pitch period candidate of the time the evaluation measure received as input from evaluation measure calculation section 105 becomes a maximum, as the pitch period of that subframe, outputs an pitch period index IDX indicating the determined pitch period to the outside, and feeds back the pitch period index IDX to adaptive excitation codebook 102. Furthermore, evaluation measure comparison section 106 outputs the pitch period in the first subframe to the outside and adaptive excitation codebook 102, and also to pitch period storage section 107.

Pitch period storage section 107 stores the pitch period in the first subframe received as input from evaluation measure comparison section 106 and outputs, when a subframe index received as input on a per subframe basis indicates a second subframe, the stored, first subframe pitch period to pitch period indication section 101.

The individual sections in adaptive excitation vector quantization apparatus 100 perform the following operations.

Pitch period indication section 101 sequentially indicates, when a subframe index received as input on a per subframe basis indicates the first subframe, a pitch period candidate T for the first subframe within a preset pitch period search range having preset pitch period resolution, to adaptive excitation vector generation section 103. On the other hand, when a subframe index received as input on a per subframe basis indicates a second subframe, pitch period indication section 101 calculates a pitch period search range and pitch period resolution for a second subframe based on the pitch period in the first subframe received as input from pitch period storage section 107 and sequentially indicates the pitch period candidate T for the second subframe within the calculated pitch period search range, to adaptive excitation vector generation section 103. The internal configuration and detailed operations of pitch period indication section 101 will be described later.

Adaptive excitation codebook 102 incorporates a buffer for storing excitations and updates the excitations using an adaptive excitation vector having a pitch period T' indicated by the pitch period index IDX fed back from evaluation measure comparison section 106 every time pitch period search, carried out per subframe, is finished.

Adaptive excitation vector generation section 103 extracts the adaptive excitation vector having the pitch period candidate T indicated from pitch period indication section 101, by the subframe length m, from adaptive excitation codebook 102, and outputs the adaptive excitation vector as an adaptive excitation vector P(T), to evaluation measure calculation section 105. For example, when adaptive excitation codebook 102 is made up of vectors having a length of e as vector elements represented by exc(0), exc(1), . . . , exc(e−1), the adaptive excitation vector P(T) generated by adaptive excitation vector generation section 103 is represented by equation 1 below.

(Equation 1)

$$P(T) = P\begin{bmatrix} exc(e-T) \\ exc(e-T+1) \\ \vdots \\ exc(\mathrm{e_T}+m-1) \end{bmatrix} \quad [1]$$

Figure 2:
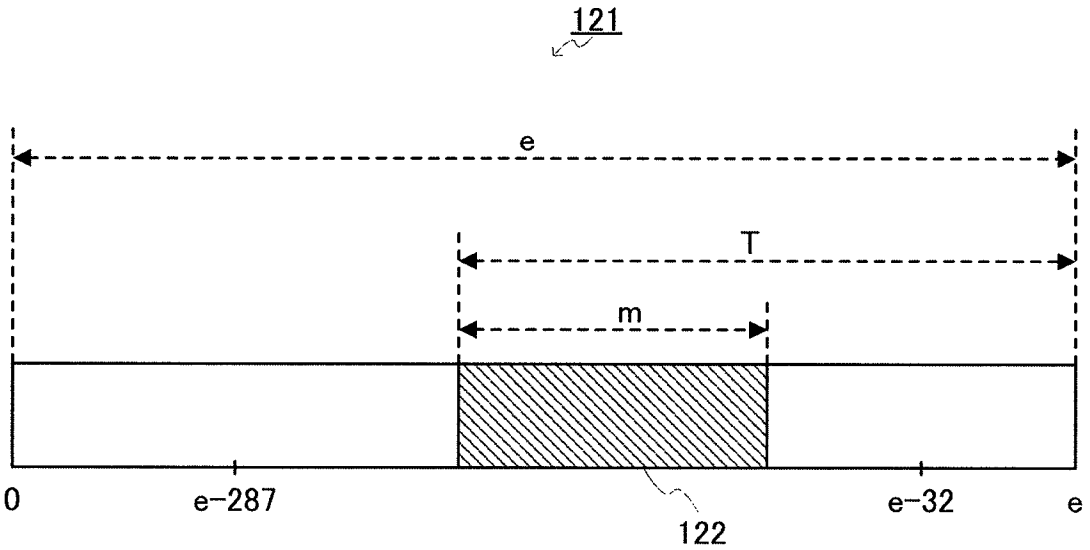
FIG. 2 shows an excitation provided in the adaptive excitation codebook according to the embodiment of the present invention.

FIG. 2 shows an excitation provided in adaptive excitation codebook 102.

In FIG. 2, "e" denotes the length of excitation 121, "m" denotes the length of the adaptive excitation vector P(T) and "T" denotes a pitch period candidate indicated from pitch period indication section 101. As shown in FIG. 2, adaptive excitation vector generation section 103 extracts portion 122 having the subframe length m from a position at a distance of T from the end (position of e) of excitation 121 (adaptive excitation codebook 102) as the starting point in the direction of the end e from here to generate the adaptive excitation vector P(T). Here, when the value of T is less than m, adaptive excitation vector generation section 103 may repeat the extracted portion until the length thereof is the subframe length m. Adaptive excitation vector generation section 103 repeats the extraction processing represented by equation 1 above on all T's within the search range indicated by pitch period indication section 101.

Synthesis filter 104 makes up a synthesis filter using the linear prediction coefficients received as input on a per subframe basis. Synthesis filter 104 generates, when a subframe index received as input on a per subframe basis indicates the first subframe, an impulse response matrix represented by equation 2 below, or generates, when a subframe index indicates a second subframe, an impulse response matrix represented by equation 3 below, and outputs the impulse response matrix to evaluation measure calculation section 105.

(Equation 2)

$$H = \begin{bmatrix} h(0) & 0 & \dots & 0 \\ h(1) & h(0) & \dots & 0 \\ \vdots & \vdots & \ddots & \vdots \\ h(m-1) & h(m-2) & \dots & h(0) \end{bmatrix} \quad [2]$$

(Equation 3)

$$\mathrm{H_ahead} = \begin{bmatrix} \mathrm{h_a}(0) & 0 & \dots & 0 \\ \mathrm{h_a}(1) & \mathrm{h_a}(0) & \dots & 0 \\ \vdots & \vdots & \ddots & \vdots \\ \mathrm{h_a}(m-1) & \mathrm{h_a}(m-2) & \dots & \mathrm{h_a}(0) \end{bmatrix} \quad [3]$$

As shown in equation 2 and equation 3, both the impulse response matrix H when the subframe index indicates the first subframe and the impulse response matrix H_ahead when a subframe index indicates a second subframe, are obtained for the subframe length m.

When a subframe index received as input on a per subframe basis indicates the first subframe, evaluation measure calculation section 105 receives a target vector X represented by equation 4 below, and also receives the impulse response matrix H from synthesis filter 104, calculates an evaluation measure Dist(T) for pitch period search according to equation 5 below, and outputs the evaluation measure Dist(T) to evaluation measure comparison section 106. On the other hand, when a subframe index received as input in adaptive excitation vector quantization apparatus 100 on a per frame basis indicates a second subframe, evaluation measure calculation section 105 receives a target vector X_ahead represented by equation 6 below, also receives the impulse response matrix H_ahead from synthesis filter 104, calculates an evaluation measure Dist(T) for pitch period search according to equation 7 below and outputs the evaluation measure Dist(T) to evaluation measure comparison section 106.

(Equation 4)

$$X = [x(0)\ x(1)\ \ldots\ x(m-1)] \quad [4]$$

(Equation 5)

$$Dist(T) = \frac{(XHP(T))^2}{|HP(T)|^2} \quad [5]$$

(Equation 6)

$$\text{X_ahead} = [x(m)\ x(m+1)\ \ldots\ x(n-1)] \quad [6]$$

(Equation 7)

$$Dist(T) = \frac{(\text{X_ahead}\,\text{H_ahead}\,\text{P}(T))^2}{|\text{H_ahead}\,\text{P}(T)|^2} \quad [7]$$

As shown in equation 5 and equation 7, evaluation measure calculation section 105 calculates a square error between a reproduced vector obtained by convoluting the impulse response matrix H or H_ahead generated in synthesis filter 104 and the adaptive excitation vector P(T) generated in adaptive excitation vector generation section 103 and the target vector X or X_ahead as an evaluation measure. When calculating the evaluation measure Dist(T), evaluation measure calculation section 105 generally uses a matrix H' (=H×W) or H'_ahead (=H_ahead×W) obtained by multiplying the impulse response matrix H or H_ahead by an impulse response matrix W of a perceptual weighting filter included in the CELP speech encoding apparatus instead of the impulse response matrix H or H_ahead in equation 5 or equation 7 above. However, suppose no distinction is made between H or H_ahead and H' or H'_ahead, and H or H_ahead will be described in the following explanations.

Based on the subframe indexes received as input on a per subframe basis, in each subframe, evaluation measure comparison section 106 determines the pitch period candidate T of the time the evaluation measure Dist(T) received as input from evaluation measure calculation section 105 becomes a maximum, as the pitch period of that subframe. Evaluation measure comparison section 106 then outputs the pitch period index IDX indicating the calculated pitch period T' to the outside and also to adaptive excitation codebook 102. Furthermore, of the evaluation measures Dist(T) from evaluation measure calculation section 105, evaluation measure comparison section 106 makes comparisons on all evaluation measures Dist(T) corresponding to the second subframe. Evaluation measure comparison section 106 obtains a pitch period T' corresponding to the maximum evaluation measure Dist(T) as an optimal pitch period, outputs a pitch period index IDX indicating the pitch period T' obtained, to the outside and also to adaptive excitation codebook 102. Furthermore, evaluation measure comparison section 106 outputs the pitch period T' in the first subframe to the outside and adaptive excitation codebook 102 and also to pitch period storage section 107.

Figure 3:
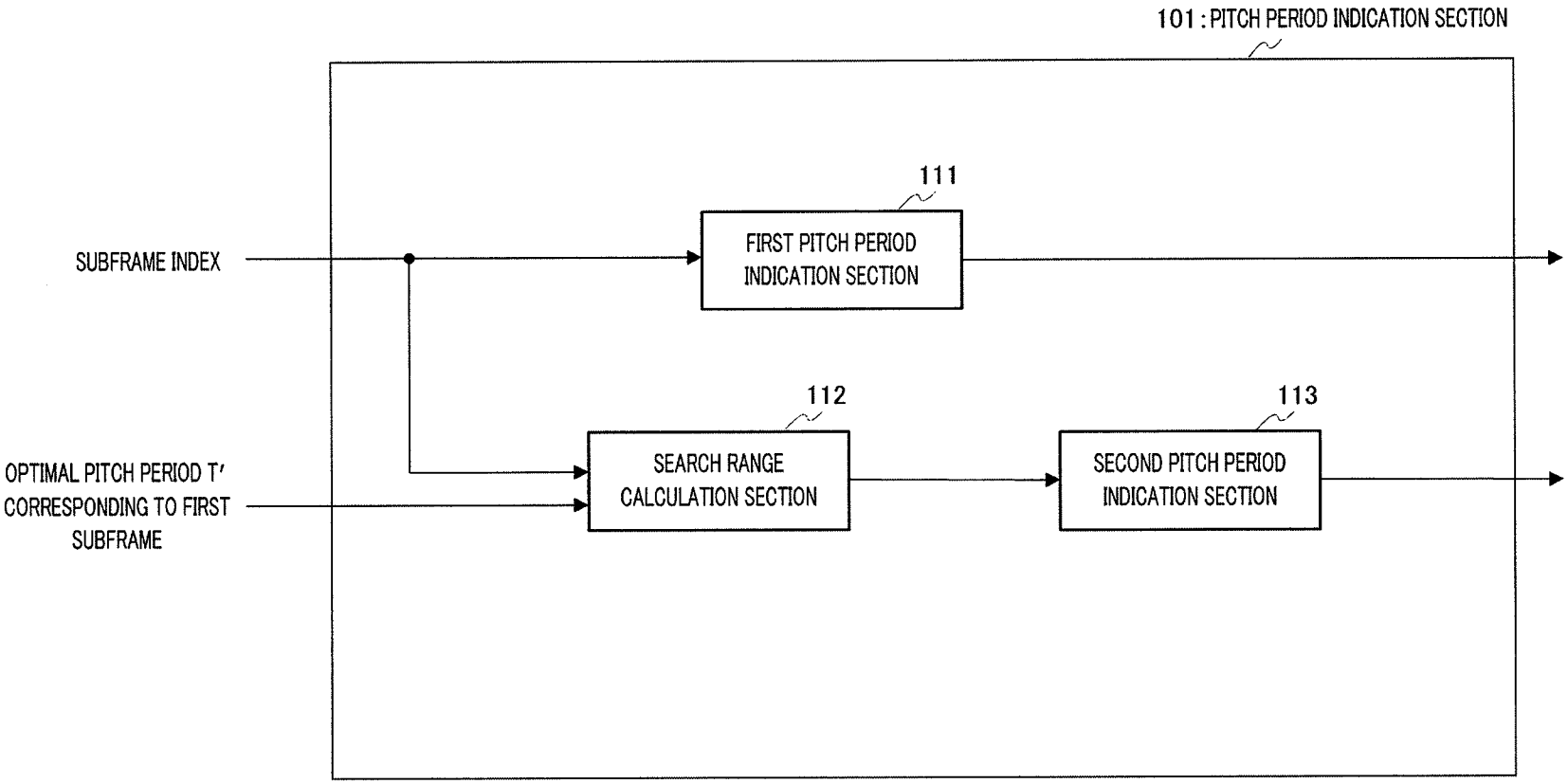
FIG. 3 is a block diagram showing an internal configuration of the pitch period indication section according to the embodiment of the present invention.

FIG. 3 is a block diagram illustrating an internal configuration of pitch period indication section 101 according to the present embodiment.

Pitch period indication section 101 is provided with first pitch period indication section 111, search range calculation section 112 and second pitch period indication section 113.

When a subframe index received as input on a per subframe basis indicates the first subframe, first pitch period indication section 111 sequentially indicates pitch period candidates T within a pitch period search range for the first subframe to adaptive excitation vector generation section 103. Here, the pitch period search range in a first subframe is preset and the search resolution is also preset. For example, when adaptive excitation vector quantization apparatus 100 searches a pitch period range from 39 to 237 in the first subframe at integer precision and searches a pitch period range from 20 to 38+⅔ at ⅓ precision, first pitch period indication section 111 sequentially indicates pitch periods T=20, 20+⅓, 20+⅔, 21, 21+⅓, . . . , 38+⅔, 39, 40, 41, . . . , 237 to adaptive excitation vector generation section 103.

When a subframe index received as input on a per subframe basis indicates a second subframe, search range calculation section 112 uses the "delta lag" pitch period search method based on the pitch period T' in the first subframe received as input from pitch period storage section 107, and further calculates the pitch period search range in a second subframe, so that the search resolution transitions, with respect to a boundary of a predetermined pitch period, and outputs the pitch period search range in a second subframe to second pitch period indication section 113.

Second pitch period indication section 113 sequentially indicates the pitch period candidates T within the search range calculated in search range calculation section 112, to adaptive excitation vector generation section 103.

Here, the "delta lag" pitch period search method whereby portions before and after the pitch period in the first subframe are candidates in the pitch period search in the second subframe will be explained in further detail with some examples. For example, when a second subframe is searched as follows: a pitch period range from T'_int−2+⅓ to T'_int+1+⅔ before and after an integer component (T'_int) of the pitch period T' in the first subframe is searched at ⅓ precision and pitch period ranges from T'_int−3 to T'_int−2 and from T'_int+2 to T'_int+4 are searched at integer precision, T=T'_int−3, T'_int−2, T'_int−2+⅓, T'_int−2+⅔, T'_int−1, T'_int−1+⅓, . . . , T'_int+1+⅓, T'_int+1+⅔, T'_int+2, T'_int+3, T'_int+4 are sequentially indicated to adaptive excitation vector generation section 103 as pitch period candidates T for the second subframe.

Figure 4:
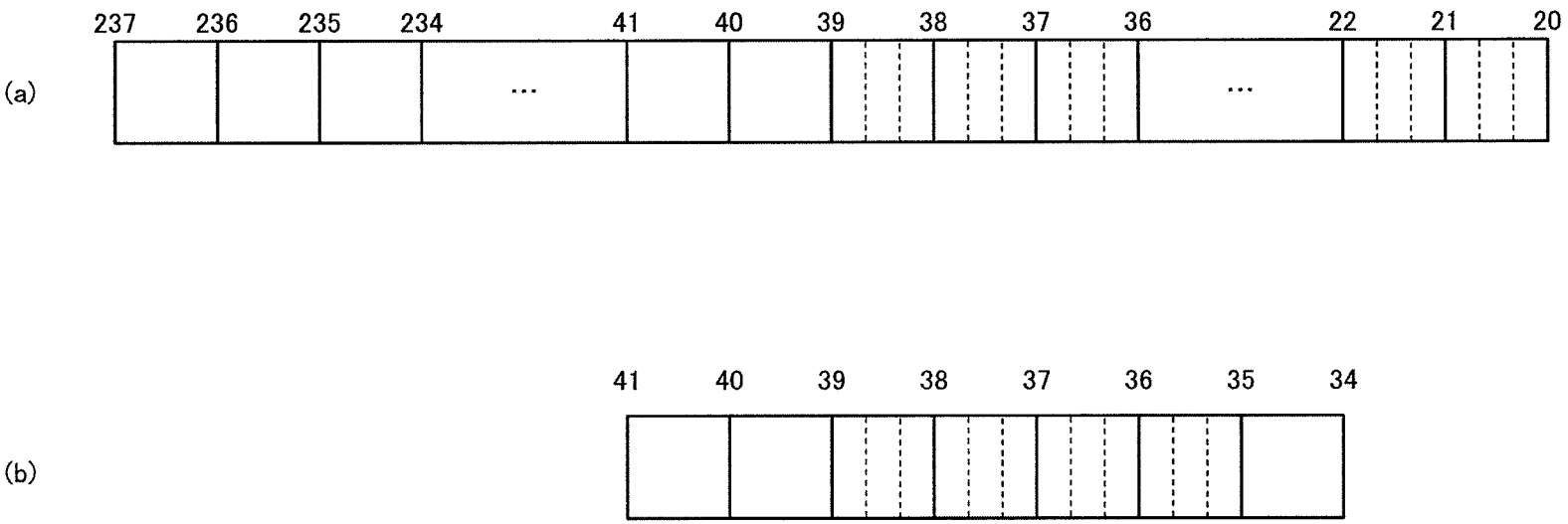
FIG. 4 illustrates a pitch period search method called "delta lag" according to prior art.

FIG. 4 illustrates a more detailed example to explain the above pitch period search method called "delta lag."

FIG. 4(*a*) illustrates the pitch period search range in a first subframe and FIG. 4(*b*) illustrates the pitch period search range in a second subframe. In the example shown in FIG. 4, pitch period search is performed using a total of 256 candidates (8 bits) from 20 to 237, that is, 199 candidates from 39 to 237 at integer precision and 57 candidates from 20 to 38+⅔ at ⅓ precision. When the search result shows that "37" is determined as the pitch period T' in the first subframe, the "delta lag" pitch period search method is used and the pitch period search in a second subframe is carried out using 16 candidates (4 bits) from T'_int−3=37−3=34 to T'_int+4=37+4=41.

Figure 5:
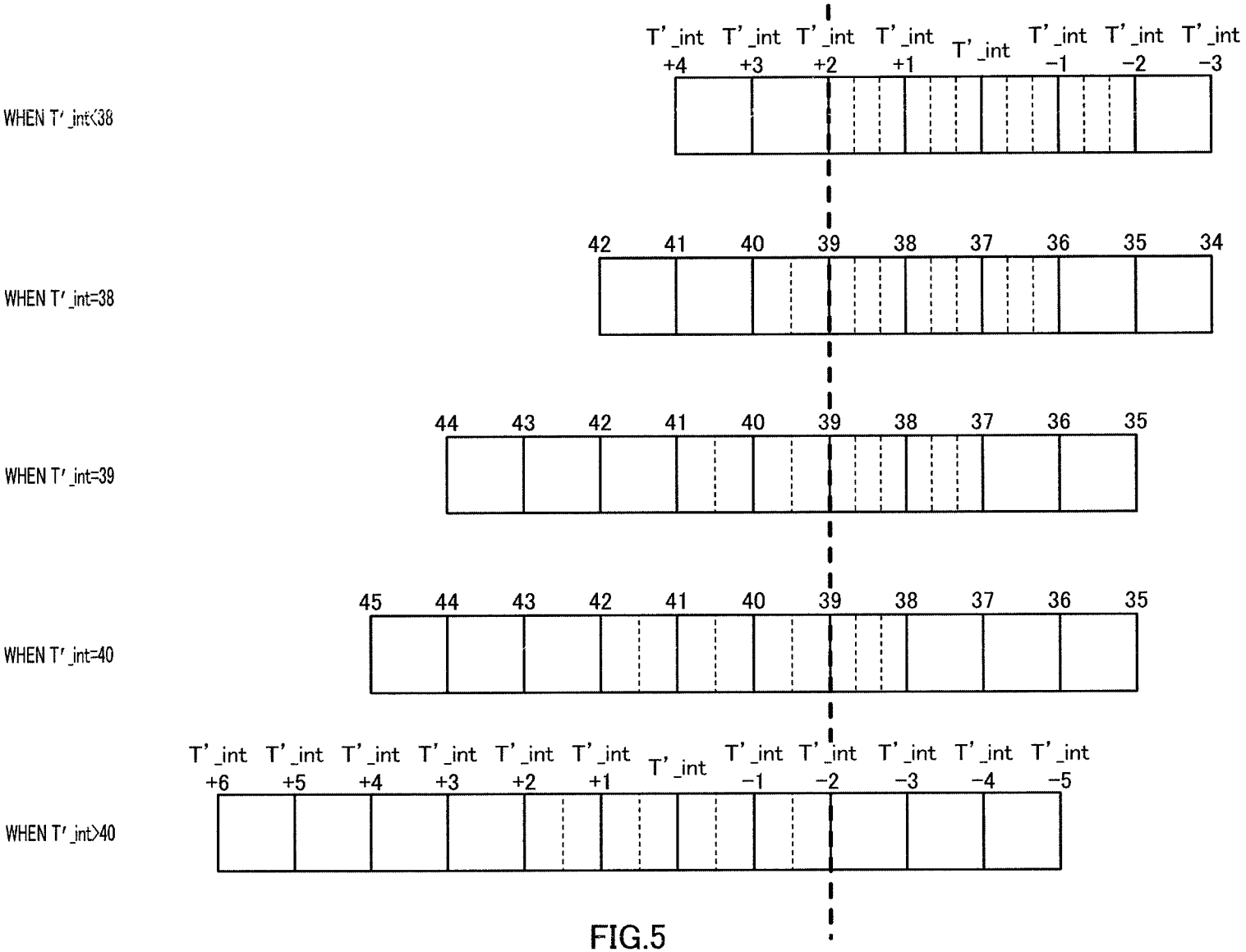
FIG. 5 shows an example of calculation results of pitch period search range and pitch period search resolution for a second subframe calculated in the search range calculation section according to the embodiment of the present invention.

FIG. 5 shows examples of results of calculating the pitch period search range in a second subframe by search range calculation section 112 according to the present embodiment so that search resolution transitions with respect to a boundary of a predetermined pitch period "39." As shown in FIG. 5, as T'_int becomes smaller, the present embodiment increases the resolution of pitch period search in a second subframe and narrows the pitch period search range. For example, when T'_int is smaller than "38" which is a first threshold, suppose the range from T'_int−2 to T'_int+2 is subject to search at ⅓ precision and the range subject to pitch period search at integer precision, is from T'_int−3 to T'_int+4. On the other hand, when T'_int is greater than "40," which is a second threshold, suppose the range from T'_int−2 to T'_int+2 is subject to search at ½ precision and the range subject to pitch period search at integer precision, is from T'_int−5 to T'_int+6. Here, since the number of bits used in the pitch period search in the second subframe is fixed, the search range becomes narrower as the search resolution increases, whereas the search range becomes wider if the search resolution decreases. Furthermore, as shown in FIG. 5, the present embodiment fixes the search range at decimal precision from T0_int−2 to T0_int+2 and causes the search resolution to transition from ½ precision to ⅓ precision, with respect to a boundary of "39," which is a third threshold. As is clear from FIG. 5 and FIG. 4(*a*), the present embodiment calculates the pitch period search range in a second subframe according to the pitch period search resolution of the first subframe and performs search using fixed search resolution for a predetermined pitch period whether for the first subframe or for the second subframe.

Figure 6:
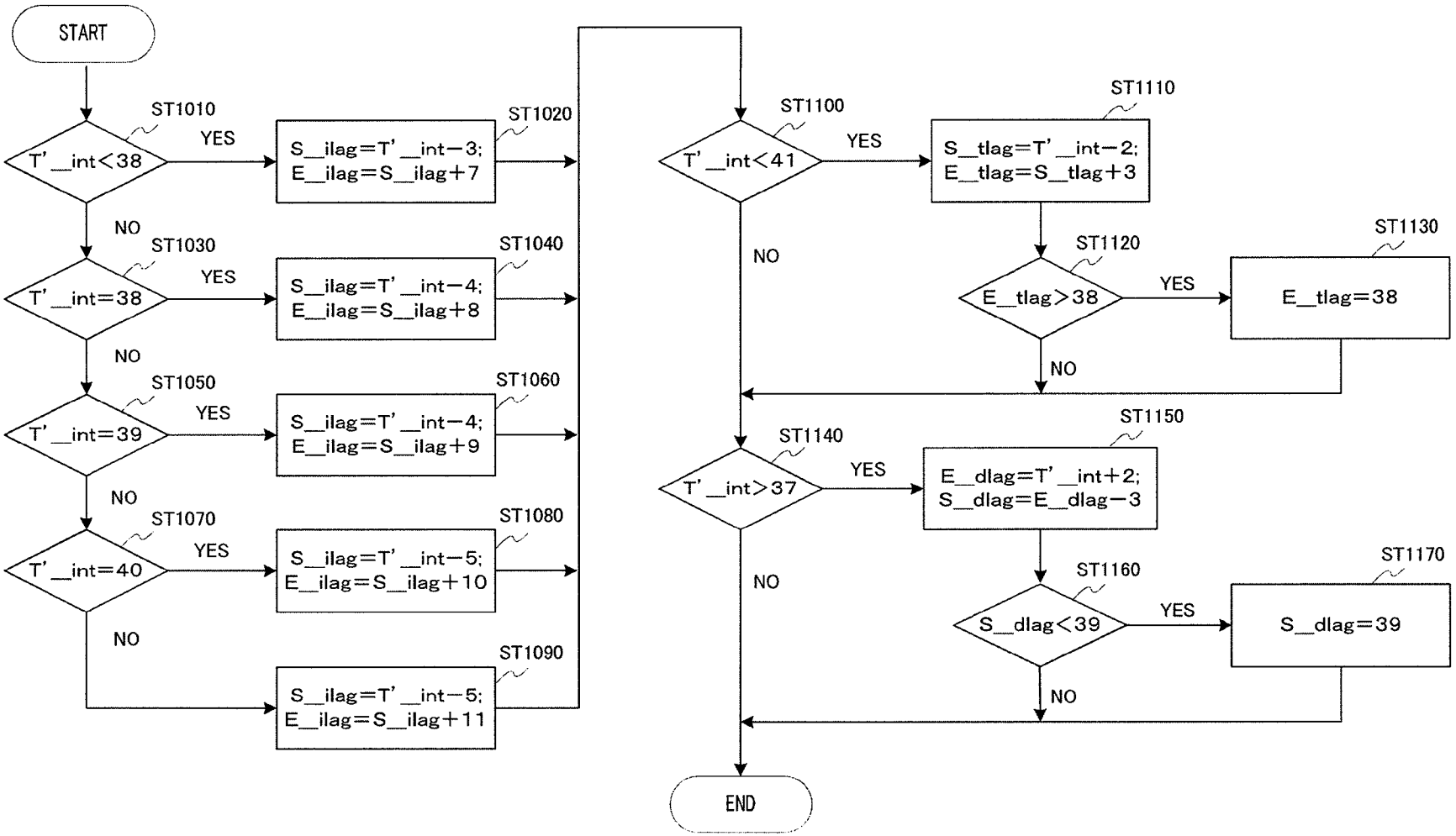
FIG. 6 is a flowchart showing the steps of calculating a pitch period search range and pitch period search resolution for a second subframe by the search range calculation section according to the embodiment of the present invention.

FIG. 6 is a flowchart showing the steps of search range calculation section 112 to calculate the pitch period search range of a second subframe as shown in FIG. 5.

In FIG. 6, S_ilag and E_ilag denote the starting point and end point of search range at integer precision, S_dlag and E_dlag denote the starting point and end point of search range at ½ precision of search range at ½ precision and S_tlag and E_tlag denote the starting point and end point of search range at ⅓ precision. Here, the search range of ½ precision and the search range of ⅓ precision are included in the search range at integer precision. That is, the search range at integer precision covers all pitch period search ranges for a second subframe, and pitch period search at integer precision is performed in all of these search ranges, except for the search range of decimal precision.

In FIG. 6, step ("ST") 1010 to ST1090 show the steps of calculating the search range for integer precision, ST1100 to ST1130 show the steps of calculating the search range of ⅓ precision and ST1140 to ST1170 show the steps of calculating the search range of ½ precision.

To be more specific, search range calculation section 112 compares the value of the integer component T'_int of the pitch period T' in the first subframe with three thresholds "38", "39" and "40," sets, when T'_int<38 (ST1010: YES), T'_int−3 as the starting point S_ilag of the search range for integer precision and sets S_ilag+7 as the end point E_ilag of the search range for integer precision (ST1020). Furthermore, search range calculation section 112 sets, when T'_int=38 (ST1030: YES), T'_int−4 as the starting point S_ilag of the search range for integer precision and sets S_ilag+8 as the end point E_ilag of the search range for integer precision (ST1040). Furthermore, search range calculation section 112 sets, when T'_int=39 (ST1050: YES), T'_int−4 as the starting point S_ilag of the search range for integer precision and sets S_ilag+9 as the end point E_ilag of the search range for integer precision (ST1060). Next, search range calculation section 112 sets, when T'_int=40 (ST1070: YES), T'_int−5 as the starting point S_ilag of the search range for integer precision and sets S_ilag+10 as the end point E_ilag of the search range for integer precision (ST1080). Next, search range calculation section 112 sets, when T'_int is not 40 (ST1070: NO), that is, when T'_int>40, T'_int−5 as the starting point S_ilag of the search range for integer precision and sets S_ilag+11 as the end point E_ilag of the search range for integer precision (ST1090). As described above, the present embodiment increases the pitch period search range at integer precision for a second subframe, that is, the overall pitch period search range for a second subframe as the pitch period T' in the first subframe increases.

Next, search range calculation section 112 compares T'_int with fourth threshold "41," and sets, when T'_int<41 (ST1100: YES), T'_int−2 as the starting point S_tlag of the search range of ⅓ precision and sets S_tlag+3 as the end point E_tlag of the search range of ⅓ precision (ST1110). Next, search range calculation section 112 sets, when the end point E_tlag of the search range of ⅓ precision is greater than "38" (ST1120: YES), "38" as the end point E_tlag of the search range of ⅓ precision (ST1130). Next, search range calculation section 112 sets, when T'_int is greater than fifth threshold "37" (ST1140: YES), T'_int+2 as the end point E_dlag of the search range of ½ precision and sets E_dlag−3 as the starting point S_dlag of the search range of ½ precision (ST1150). Next, search range calculation section 112 sets, when the starting point S_dlag of the search range of ½ precision is less than "39" (ST1160: YES), "39" as the starting point S_dlag of the search range of ½ precision (ST1170).

When search range calculation section 112 calculates the search range following the steps shown in FIG. 6 above, the pitch period search range in a second subframe as shown in FIG. 5 is obtained. Hereinafter, using the pitch period search range calculated in search range calculation section 112, the method of performing pitch period search in the second subframe will be compared with the pitch period search method described in aforementioned Patent Document 1.

Figure 7:
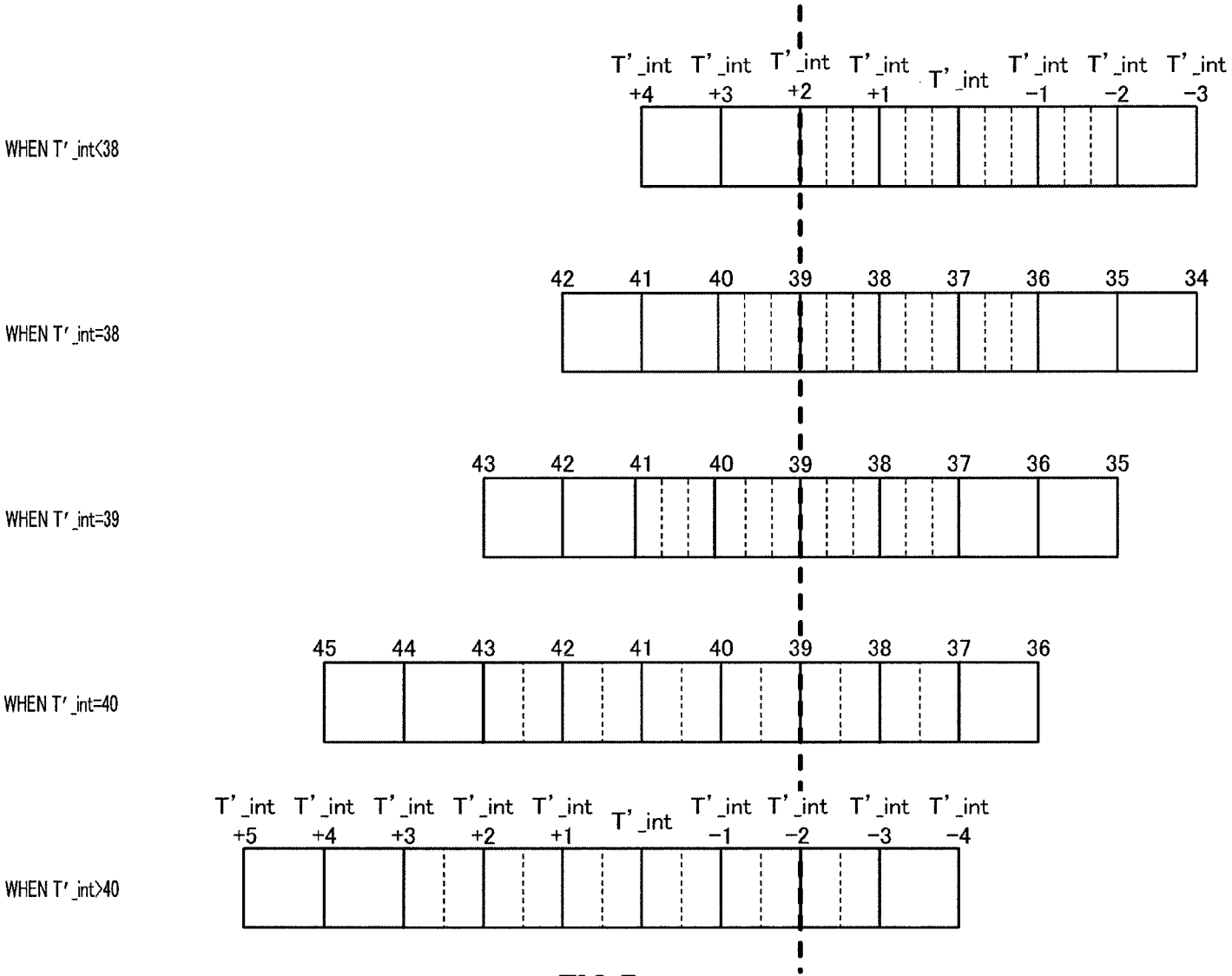
FIG. 7 illustrates effects of a pitch period search method according to prior art.

FIG. 7 illustrates effects of the pitch period search method described in Patent Document 1.

FIG. 7 illustrates the pitch period search range in a second subframe, and as shown in FIG. 7, according to the pitch period search method described in Patent Document 1, an integer component T'_int of the pitch period T' in the first subframe is compared with threshold "39," and, when T'_int is equal to or less than "39," the range of T'_int−3 to T'_int+4 is set as a search range of integer precision and the range of T'_int−2 to T'_int+2 included in this search range of integer precision is set as a search range of ⅓ precision. Furthermore, when T'_int is greater than threshold "39," the range of T'_int−4 to T'_int+5 is set as a search range of integer precision and the range of T'_int−3 to T'_int+3 included in this search range of integer precision is set as a search range of ½ precision.

As is obvious from a comparison between FIG. 7 and FIG. 5, according to the pitch period search method described in Patent Document 1 as well as the pitch period search method according to the present embodiment, it is possible to change the pitch period search range and pitch period search resolution in a second subframe according to the value of the integer component T'_int of the pitch period T' in the first subframe, but it is not possible to change the resolution of pitch period search with respect to a boundary of a predetermined threshold (for example, "39"). Therefore, pitch period search cannot be performed using fixed decimal precision resolution for a predetermined pitch period. On the other hand, the present embodiment can always perform search at ½ precision for a pitch period of, for example, "39" or less, and can reduce the number of filters to mount to generate an adaptive excitation vector of decimal precision.

The configuration and operation of adaptive excitation vector quantization apparatus 100 according to the present embodiment has been explained so far.

The CELP speech encoding apparatus including adaptive excitation vector quantization apparatus 100 transmits speech encoded information including a pitch period index IDX generated by evaluation measure comparison section 106 to the CELP decoding apparatus including the adaptive excitation vector dequantization apparatus according to the present embodiment. The CELP decoding apparatus decodes the received, speech encoded information, to acquire a pitch period index IDX and outputs the pitch period index IDX to the adaptive excitation vector dequantization apparatus according to the present embodiment. The speech decoding processing by the CELP decoding apparatus is also performed in subframe units in the same way as the speech encoding processing by the CELP speech encoding apparatus, and the CELP decoding apparatus outputs a subframe index to the adaptive excitation vector dequantization apparatus according to the present embodiment.

Figure 8:
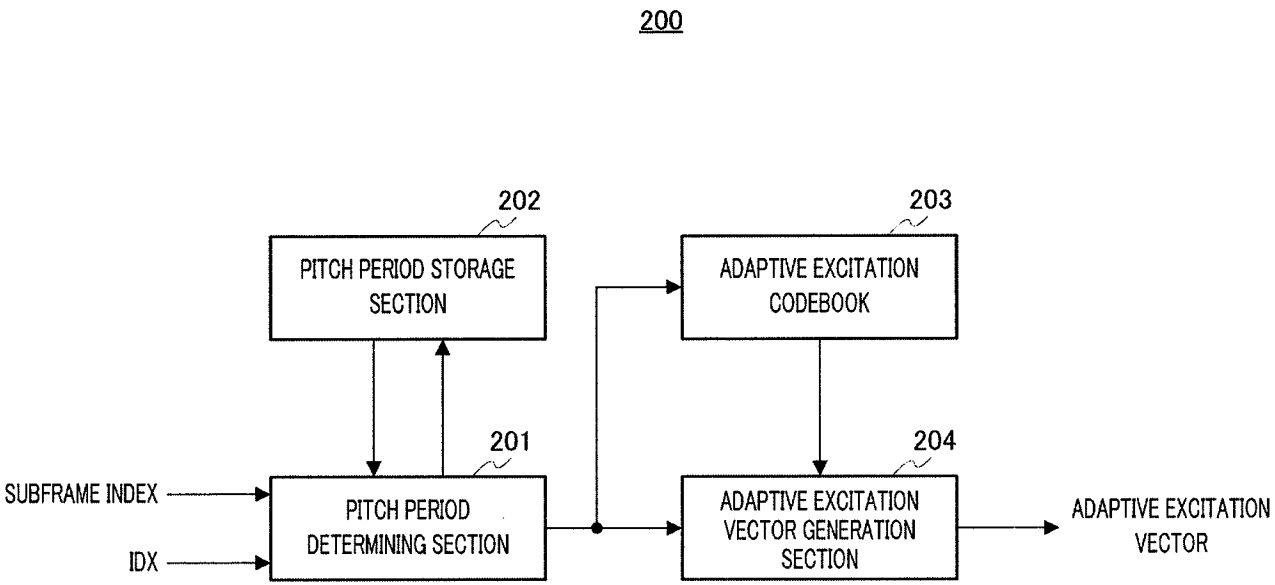
FIG. 8 is a block diagram showing a main configuration of an adaptive excitation vector dequantization apparatus according to the embodiment of the present invention.

FIG. 8 is a block diagram showing a main configuration of adaptive excitation vector dequantization apparatus 200 according to the present embodiment.

In FIG. 8, adaptive excitation vector dequantization apparatus 200 is provided with pitch period determining section 201, pitch period storage section 202, adaptive excitation codebook 203 and adaptive excitation vector generation section 204, and receives the subframe index and pitch period index IDX generated by the CELP speech decoding apparatus.

When a sub-subframe index indicates the first subframe, pitch period determining section 201 outputs a pitch period T' corresponding to the inputted pitch period index IDX to pitch period storage section 202, adaptive excitation codebook 203 and adaptive excitation vector generation section 204. Furthermore, when a sub-subframe index indicates a second subframe, pitch period determining section 201 reads a pitch period T' stored in pitch period storage section 202 and outputs the pitch period T' to adaptive excitation codebook 203 and adaptive excitation vector generation section 204.

Pitch period storage section 202 stores the pitch period T' in the first subframe received as input from pitch period determining section 201, and pitch period determining section 201 reads the pitch period T' in the processing of a second subframe.

Adaptive excitation codebook 203 incorporates a buffer for storing excitations similar to the excitations provided in adaptive excitation codebook 102 of adaptive excitation vector quantization apparatus 100, and updates excitations using an adaptive excitation vector having the pitch period T' inputted from pitch period determining section 201 every time adaptive excitation decoding processing carried out on a per subframe basis is finished.

Adaptive excitation vector generation section 204 extracts an adaptive excitation vector P'(T') having a pitch period T' inputted from pitch period determining section 201 from adaptive excitation codebook 203 by a subframe length m, and outputs the adaptive excitation vector P'(T') as an adaptive excitation vector, for each subframe. The adaptive excitation vector P'(T') generated by adaptive excitation vector generation section 204 is represented by equation 8 below.

(Equation 8)

$$P'(T') = P'\begin{bmatrix} exc(e-T') \\ exc(e-T'+1) \\ \vdots \\ exc(\mathrm{e_T}'+m-1) \end{bmatrix} \quad [8]$$

Thus, even when a pitch period search range setting method of calculating the pitch period search range in a second subframe according to the pitch period in the first subframe is used, the present embodiment changes the resolution of pitch period search with respect to a boundary of a predetermined threshold, and can thereby perform search using fixed decimal precision resolution for a predetermined pitch period, and improve the performance of pitch period quantization. As a result, the present embodiment can reduce the number of filters to mount to generate an adaptive excitation vector in decimal precision, thereby making it possible to save memory.

A case has been explained above with the present embodiment as an example where a linear prediction residual vector is received as input and where the pitch period of the linear prediction residual vector is searched for using an adaptive excitation codebook. However, the present invention is not limited to this and a speech signal itself may be received as input and the pitch period of the speech signal itself may be directly searched for.

Furthermore, a case has been explained above with the present embodiment as an example where a range from "20" to "237" is used as pitch period candidates. However, the present invention is not limited to this and other ranges may be used as pitch period candidates.

Furthermore, a case has been explained above with the present embodiment as a premise where the CELP speech encoding apparatus including adaptive excitation vector quantization apparatus 100 divides one frame into two subframes and performs a linear predictive analysis on a per subframe basis. However, the present invention is not limited to this, but may also be based on the premise that the CELP-based speech encoding apparatus divides one frame into three or more subframes and performs a linear predictive analysis on a per subframe basis.

The adaptive excitation vector quantization apparatus and adaptive excitation vector dequantization apparatus according to the present invention can be mounted on a communication terminal apparatus in a mobile communication system that performs speech transmission, and can thereby provide a communication terminal apparatus providing operations and effects similar to those described above.

Although a case has been described with the above embodiment as an example where the present invention is implemented with hardware, the present invention can be implemented with software. For example, by describing the algorithm for the adaptive excitation vector quantization method according to the present invention in a programming language, storing this program in a memory and making an information processing section execute this program, it is possible to implement the same functions as in the adaptive excitation vector quantization apparatus and adaptive excitation vector dequantization apparatus according to the present invention.

Furthermore, each function block employed in the description of each of the aforementioned embodiments may typically be implemented as an LSI constituted by an integrated circuit. These may be individual chips or partially or totally contained on a single chip.

"LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells in an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosure of Japanese Patent Application No. 2007-053529, filed on Mar. 2, 2007, including the specification, drawings and abstract, is incorporated herein by reference in its entirety.

INDUSTRIAL APPLICABILITY

The adaptive excitation vector quantization apparatus, adaptive excitation vector dequantization apparatus and the methods thereof according to the present invention are suitable for use in speech encoding, speech decoding and so on.

The invention claimed is:

1. An adaptive excitation vector quantization apparatus that searches for a pitch period in a fixed range for a first subframe of two subframes, the two subframes being provided by dividing a frame, searches for a pitch period in a second subframe in a range determined by a result of comparison between a searched pitch period in a first subframe and a predetermined threshold, and outputs information about the searched pitch periods as quantization data, the apparatus comprising:

a first pitch period search processor that searches for a first pitch period in the first subframe by changing resolution with respect to a boundary of the predetermined threshold;

a calculation processor that calculates a pitch period search range and a search resolution in the second subframe based on the first pitch period determined in the first subframe and the predetermined threshold; and a second pitch period search processor that searches for a second pitch period in the second subframe by changing resolution based on the search resolution calculated by the calculation processor in the pitch period search range.

2. An adaptive excitation vector quantization method, executed by a processor, of searching for a pitch period in a fixed range for a first subframe of two subframes, the two subframes being provided by dividing a frame, searching for a pitch period in a second subframe in a range determined by a result of comparison between a searched pitch period in a first subframe and a predetermined threshold and outputting information about the searched pitch periods as quantization data, the method comprising:

searching for a first pitch period in the first subframe by changing resolution with respect to a boundary of the predetermined threshold;

calculating a pitch period search range and a search resolution in the second subframe based on the first pitch period determined in the first subframe and the predetermined threshold; and searching for a second pitch period in the second subframe by changing resolution based on the calculated search resolution in the pitch period search range.

3. The adaptive excitation vector quantization apparatus according to claim 1, wherein the search resolution calculated by the calculation processor comprises a first resolution and a second resolution in the pitch period search range, and the second pitch period search processor changes resolution from the first resolution to the second resolution in the pitch period search range.

4. The adaptive excitation vector quantization method according to claim 2, wherein the calculated search resolution comprises a first resolution and a second resolution in the pitch period search range, and the searching for the second pitch period changes resolution from the first resolution to the second resolution in the pitch period search range.

* * * * *